US009932995B2

(12) United States Patent
Kondo et al.

(10) Patent No.: US 9,932,995 B2
(45) Date of Patent: Apr. 3, 2018

(54) HYDRAULIC EXCAVATOR DRIVE SYSTEM

(71) Applicant: KAWASAKI JUKOGYO KABUSHIKI KAISHA, Kobe-shi, Hyogo (JP)

(72) Inventors: Akihiro Kondo, Nishinomiya (JP); Makoto Ito, Kobe (JP); Kazuto Fujiyama, Kobe (JP)

(73) Assignee: KAWASAKI JUKOGYO KABUSHIKI KAISHA, Kobe-shi (JP)

( * ) Notice: Subject to any disclaimer, the term of this patent is extended or adjusted under 35 U.S.C. 154(b) by 206 days.

(21) Appl. No.: 15/028,866

(22) PCT Filed: Oct. 10, 2014

(86) PCT No.: PCT/JP2014/005176

§ 371 (c)(1),
(2) Date: Apr. 12, 2016

(87) PCT Pub. No.: WO2015/064026

PCT Pub. Date: May 7, 2015

(65) Prior Publication Data

US 2016/0252107 A1 Sep. 1, 2016

(30) Foreign Application Priority Data

Oct. 31, 2013 (JP) ..... 2013-226450

(51) Int. Cl.
*E02F 9/22* (2006.01)
*F15B 11/17* (2006.01)
(Continued)

(52) U.S. Cl.
CPC ..... *F15B 11/17* (2013.01); *E02F 3/425* (2013.01); *E02F 3/435* (2013.01); *E02F 9/2235* (2013.01);
(Continued)

(58) Field of Classification Search
CPC ..... E02F 9/2242; E02F 9/2239; E02F 3/425; F15B 2211/30565; F15B 2211/2654; F15B 2211/31335; F15B 11/17
(Continued)

(56) References Cited

U.S. PATENT DOCUMENTS

2006/0048508 A1* 3/2006 Nakamura ..... E02F 9/2228 60/422

FOREIGN PATENT DOCUMENTS

JP 2006-029468 A 2/2006

OTHER PUBLICATIONS

Nov. 30, 2016 Search Report issued in Chinese Application No. 201480057540.1.

(Continued)

*Primary Examiner* — F. Daniel Lopez
*Assistant Examiner* — Daniel Collins
(74) *Attorney, Agent, or Firm* — Oliff PLC

(57) ABSTRACT

A hydraulic excavator drive system includes: a first hydraulic pump and a second hydraulic pump, whose respective tilting angles are controllable independently of each other; an arm main control valve and an arm auxiliary control valve each for controlling supply of hydraulic oil to an arm cylinder; and a boom main control valve and a boom auxiliary control valve each for controlling supply of the hydraulic oil to a boom cylinder. An arm operation valve outputs a pilot pressure to the arm main control valve. A boom operation valve outputs a pilot pressure to the boom main control valve. A pair of arm-side regulating valves outputs no pilot pressure to the arm auxiliary control valve and a boom-side regulating valve outputs no pilot pressure to the boom auxiliary control valve when an arm crowding operation and a boom raising operation are performed concurrently.

10 Claims, 8 Drawing Sheets

(51) Int. Cl.

| | |
|---|---|
| ***E02F 3/42*** | (2006.01) |
| ***E02F 3/43*** | (2006.01) |
| *E02F 3/32* | (2006.01) |
| *E02F 9/12* | (2006.01) |

(52) U.S. Cl.
CPC ..... *E02F 9/2242* (2013.01); *E02F 9/2282* (2013.01); *E02F 9/2285* (2013.01); *E02F 9/2292* (2013.01); *E02F 9/2296* (2013.01); *E02F 3/32* (2013.01); *E02F 9/123* (2013.01); *F15B 2211/20576* (2013.01); *F15B 2211/30565* (2013.01); *F15B 2211/31582* (2013.01); *F15B 2211/6316* (2013.01); *F15B 2211/665* (2013.01); *F15B 2211/782* (2013.01)

(58) Field of Classification Search
USPC ..... 60/422, 428
See application file for complete search history.

(56) References Cited

OTHER PUBLICATIONS

Dec. 22, 2014 Search Report issued in International Patent Application No. PCT/JP2014/005176.
May 3, 2016 International Preliminary Report on Patentability issued in International Patent Application No. PCT/JP2014/005176.

* cited by examiner

HYDRAULIC EXCAVATOR DRIVE SYSTEM

TECHNICAL FIELD

The present invention relates to a hydraulic excavator drive system.

BACKGROUND ART

Generally speaking, a hydraulic excavator drive system includes a turning motor, a boom cylinder, an arm cylinder, and a bucket cylinder as hydraulic actuators. Two hydraulic pumps supply hydraulic oil to these hydraulic actuators. Usually, the supply of the hydraulic oil to the turning motor is controlled by one control valve, and the supply of the hydraulic oil to the bucket cylinder is controlled by another control valve. Meanwhile, the supply of the hydraulic oil to the boom cylinder (at least when a boom raising operation is performed) is controlled by two control valves, and the supply of the hydraulic oil to the arm cylinder is controlled by other two control valves.

For example, Patent Literature 1 discloses a hydraulic excavator drive system 100 as shown in FIG. 9. In the drive system 100, an arm main control valve 121 and a boom auxiliary control valve 132 are disposed on a first bleed line 102 extending from a first hydraulic pump 101, and an arm auxiliary control valve 122, a bucket control valve 110, and a boom main control valve 131 are disposed on a second bleed line 104 extending from a second hydraulic pump 103.

The arm main control valve 121 is connected to an arm operation valve 120 by an arm crowding pilot line 123, and the boom main control valve 131 is connected to a boom operation valve 130 by a boom raising pilot line 133. An auxiliary pilot line 124 branches off from the arm crowding pilot line 123, and connects to the arm auxiliary control valve 122. Similarly, an auxiliary pilot line 134 branches off from the boom raising pilot line 133, and connects to the boom auxiliary control valve 132. The auxiliary pilot lines 124 and 134 are provided with solenoid proportional valves 125 and 135, respectively.

Each of the solenoid proportional valves 125 and 135 outputs a pilot pressure to the auxiliary control valve (122 or 132), the pilot pressure decreasing in accordance with an increase in a pilot pressure outputted from the operation valve (120 or 130). That is, the pilot pressures outputted from the solenoid proportional valves to the auxiliary control valves are inversely proportional to the pilot pressures outputted from the operation valves to the main control valves. When a pilot pressure led to an auxiliary control valve decreases, the degree of opening of the auxiliary control valve is reduced. Patent Literature 1 describes that, owing to this configuration, when an arm crowding operation and a boom raising operation are performed concurrently, the hydraulic oil can be preferentially supplied to one of an arm cylinder 126 and a boom cylinder 136. The time when an arm crowding operation and a boom raising operation are performed concurrently means the time when the bucket is moved horizontally in a manner to bring the bucket closer to the body of the excavator.

CITATION LIST

Patent Literature

PTL 1: Japanese Laid-Open Patent Application Publication No. 2006-29468

SUMMARY OF INVENTION

Technical Problem

In the drive system 100 shown in FIG. 9, the arm auxiliary control valve 122 and the boom auxiliary control valve 132 move not in accordance with the load pressures of the arm cylinder 126 and the boom cylinder 136 but in accordance with the pilot pressures outputted from the arm operation valve 120 and the boom operation valve 130. In addition, although the degree of opening of both the auxiliary control valves 122 and 132 is reduced, the degree of opening is not reduced to zero, and the hydraulic oil is supplied to the arm cylinder 126 and the boom cylinder 136 from both the first hydraulic pump 101 and the second hydraulic pump 103. Accordingly, when an arm crowding operation and a boom raising operation are performed concurrently, a problem that a large amount of hydraulic oil flows into one of the arm cylinder 126 and the boom cylinder 136 whose load pressure is lower is improved to some extent owing to the reduction of the degree of opening of both the auxiliary control valves 122 and 132.

However, in the drive system 100 shown in FIG. 9, unnecessary pressure loss occurs in hydraulic oil supply paths to the cylinders 126 and 136 due to the reduction of the degree of opening of the auxiliary control valves 122 and 132. As a result, energy is consumed wastefully.

In view of the above, an object of the present invention is to provide a hydraulic excavator drive system that is capable of preventing a large amount of hydraulic oil from flowing into one of the arm cylinder and the boom cylinder whose load pressure is lower and suppressing wasteful energy consumption when an arm crowding operation and a boom raising operation are performed concurrently.

Solution to Problem

In order to solve the above-described problems, the inventors of the present invention conducted a diligent study. As a result of the study, they have found out that when an arm crowding operation and a boom raising operation are performed concurrently, by blocking a supply line from the arm auxiliary control valve to the arm cylinder and also blocking a supply line from the boom auxiliary control valve to the boom cylinder, one hydraulic pump can be used as a pump dedicated for the arm cylinder and the other hydraulic pump can be used as a pump dedicated for the boom cylinder. In addition, in this case, the discharge pressures of both the hydraulic pumps can be made different from each other. Accordingly, by performing horsepower control of both the hydraulic pumps independently of each other (independent horsepower control), the amount of hydraulic oil supplied to the arm cylinder can be set based on horsepower control characteristics of one of the hydraulic pumps, and the amount of hydraulic oil supplied to the boom cylinder can be set based on horsepower control characteristics of the other hydraulic pump. Specifically, in an ordinary hydraulic excavator drive system, so-called total horse power control is performed, in which each hydraulic pump is controlled based on its discharge pressure and the discharge pressure of its counterpart hydraulic pump. In this total horse power control, the tilting angles of both the hydraulic pumps are always kept equal to each other. On the other hand, in the independent horsepower control, in which each hydraulic pump is controlled only based on its discharge pressure, i.e., not based on the discharge pressure of its counterpart hydraulic pump, the tilting angles of both the hydraulic pumps are controllable independently of each other. The present invention has been made from such a technological point of view.

Specifically, a hydraulic excavator drive system according to the present invention includes: a first hydraulic pump and a second hydraulic pump, whose respective tilting angles are controllable independently of each other, each pump discharging hydraulic oil at a flow rate corresponding to the tilting angle of the pump; an arm main control valve and an arm auxiliary control valve each for controlling supply of the hydraulic oil to an arm cylinder, the arm main control valve being disposed on a first bleed line extending from the first hydraulic pump, the arm auxiliary control valve being disposed on a second bleed line extending from the second hydraulic pump; a boom main control valve and a boom auxiliary control valve each for controlling supply of the hydraulic oil to a boom cylinder, the boom main control valve being disposed on the second bleed line, the boom auxiliary control valve being disposed on the first bleed line; an arm operation valve that outputs a pilot pressure to the arm main control valve; a boom operation valve that outputs a pilot pressure to the boom main control valve; a pair of arm-side regulating valves that output pilot pressures to the arm auxiliary control valve in accordance with an arm crowding operation and an arm pushing operation, respectively, when no boom raising operation is performed, and output no pilot pressure to the arm auxiliary control valve when an arm crowding operation and a boom raising operation are performed concurrently; and a boom-side regulating valve that outputs a pilot pressure to the boom auxiliary control valve in accordance with a boom raising operation when no arm crowding operation is performed, and outputs no pilot pressure to the boom auxiliary control valve when an arm crowding operation and a boom raising operation are performed concurrently.

According to the above configuration, the arm auxiliary control valve and the boom auxiliary control valve do not move when an arm crowding operation and a boom raising operation are performed concurrently. This makes it possible to use the first hydraulic pump as a pump dedicated for the arm cylinder and use the second hydraulic pump as a pump dedicated for the boom cylinder. This consequently makes it possible to prevent a large amount of hydraulic oil from flowing into one of the arm cylinder and the boom cylinder whose load pressure is lower. In addition, the tilting angle of the first hydraulic pump and the tilting angle of the second hydraulic pump are controllable independently of each other. In other words, independent horsepower control is performed on both the hydraulic pumps. Therefore, the amount of hydraulic oil supplied to the arm cylinder and the amount of hydraulic oil supplied to the boom cylinder can be set based on horsepower control characteristics of the first hydraulic pump and horsepower control characteristics of the second hydraulic pump, respectively. This makes it possible to prevent an occurrence of unnecessary pressure loss in a path from the first hydraulic pump to the arm cylinder and in a path from the second hydraulic pump to the boom cylinder, thereby making it possible to suppress wasteful energy consumption.

Each of the pair of arm-side regulating valves may be a solenoid proportional valve that outputs, to the arm auxiliary control valve, a pilot pressure proportional to the pilot pressure outputted from the arm operation valve when no boom raising operation is performed, and the boom-side regulating valve may be a solenoid proportional valve that outputs, to the boom auxiliary control valve, a pilot pressure proportional to the pilot pressure outputted from the boom operation valve when no arm crowding operation is performed. According to this configuration, when no boom raising operation is performed, the arm auxiliary control valve can be moved in the same manner as the arm main control valve, and when no arm crowding operation is performed, the boom auxiliary control valve can be moved in the same manner as the boom main control valve.

Each of the pair of arm-side regulating valves may be a solenoid on-off valve that blocks a pilot line intended for the arm auxiliary control valve when an arm crowding operation and a boom raising operation are performed concurrently, and the boom-side regulating valve may be a solenoid on-off valve that blocks a pilot line intended for the boom auxiliary control valve when an arm crowding operation and a boom raising operation are performed concurrently. This configuration makes it possible to realize a simpler configuration and simpler control logic than in a case where solenoid proportional valves are adopted as the regulating valves.

The above hydraulic excavator drive system may further include: a first regulator that controls the tilting angle of the first hydraulic pump based on a discharge pressure of the first hydraulic pump and a power shift pressure; a second regulator that controls the tilting angle of the second hydraulic pump based on a discharge pressure of the second hydraulic pump and the power shift pressure; and a solenoid proportional valve that outputs the power shift pressure to the first regulator and the second regulator. According to this configuration, power shift control can be performed on both the first hydraulic pump and the second hydraulic pump by the single solenoid proportional valve.

The above hydraulic excavator drive system may further include: a first regulator that controls the tilting angle of the first hydraulic pump based on a discharge pressure of the first hydraulic pump and a first power shift pressure; a first solenoid proportional valve that outputs the first power shift pressure to the first regulator; a second regulator that controls the tilting angle of the second hydraulic pump based on a discharge pressure of the second hydraulic pump and a second power shift pressure; and a second solenoid proportional valve that outputs the second power shift pressure to the second regulator. According to this configuration, power shift control of the first hydraulic pump and power shift control of the second hydraulic pump can be performed independently of each other.

For example, the above hydraulic excavator drive system may further include a controller that, when an arm crowding operation and a boom raising operation are performed concurrently, controls the first solenoid proportional valve in a manner to increase the first power shift pressure such that a discharge flow rate of the first hydraulic pump decreases, and controls the second solenoid proportional valve in a manner to decrease the second power shift pressure such that a discharge flow rate of the second hydraulic pump increases.

Advantageous Effects of Invention

The present invention makes it possible to prevent a large amount of hydraulic oil from flowing into one of the arm cylinder and the boom cylinder whose load pressure is lower and suppress wasteful energy consumption when an arm crowding operation and a boom raising operation are performed concurrently.

DESCRIPTION OF EMBODIMENTS

Embodiment 1

Figure 1:
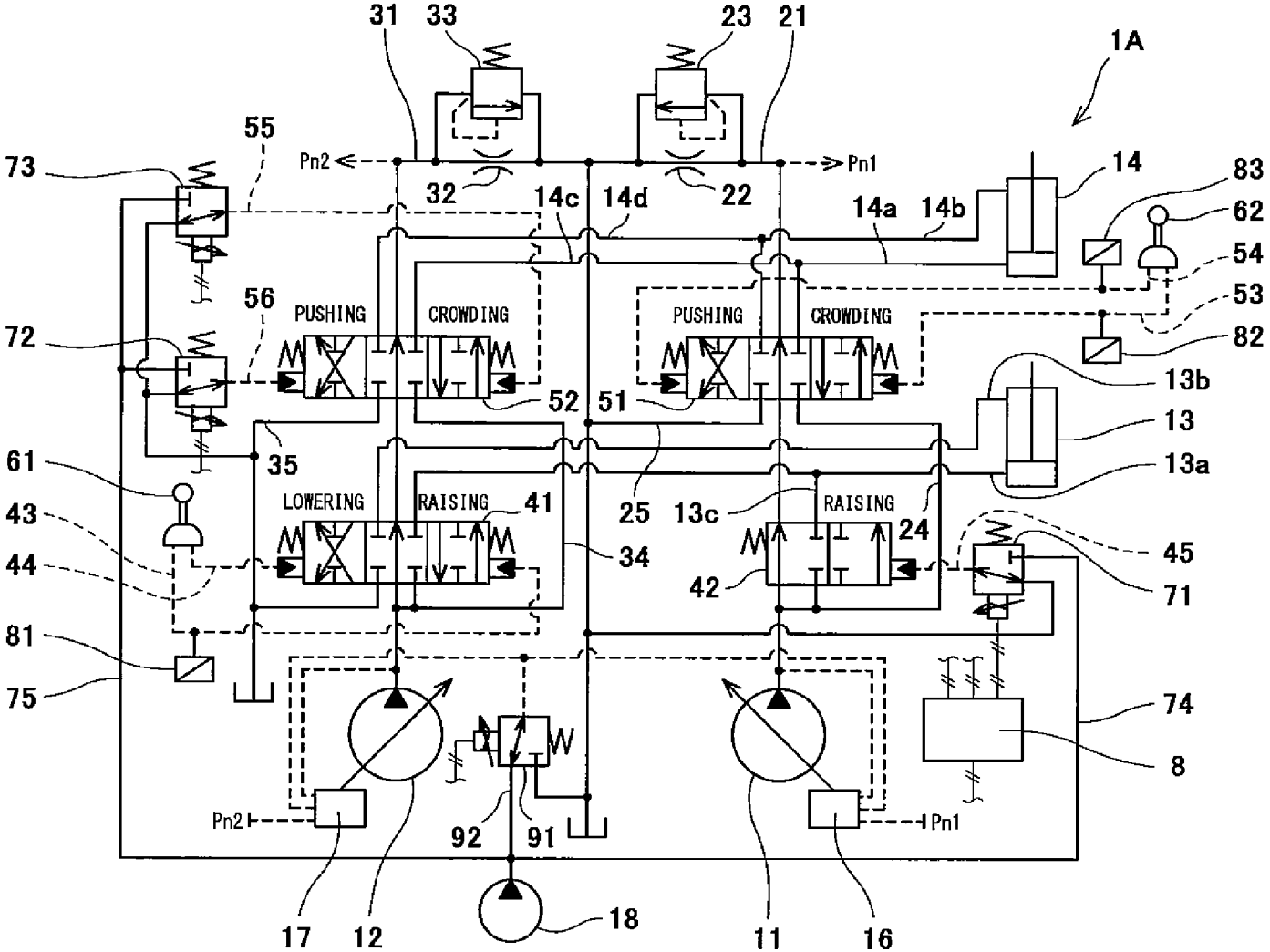
FIG. 1 is a hydraulic circuit diagram of a hydraulic excavator drive system according to Embodiment 1 of the present invention.
Figure 2:
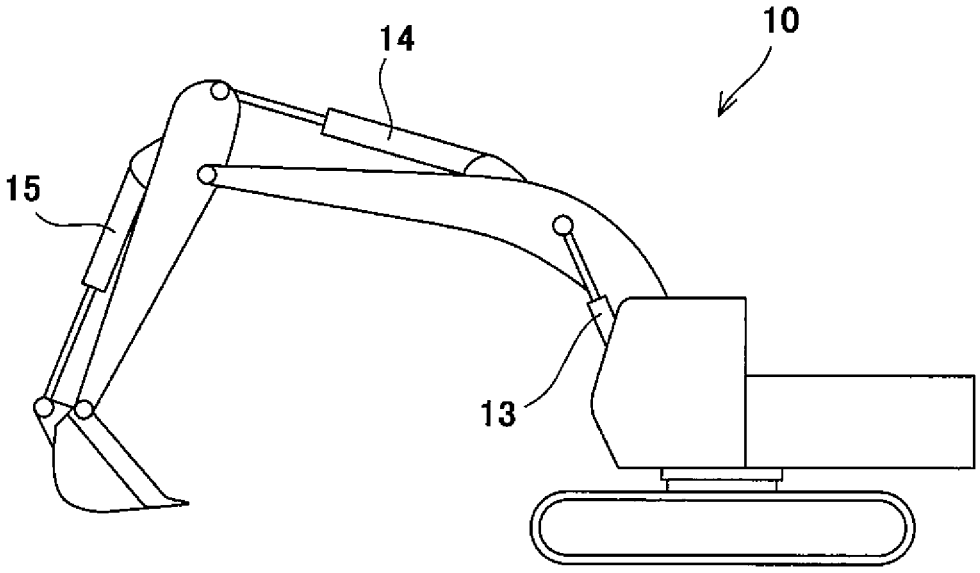
FIG. 2 is a side view of a hydraulic excavator.

FIG. 1 shows a hydraulic excavator drive system 1A according to Embodiment 1 of the present invention. FIG. 2 shows a hydraulic excavator 10, in which the drive system 1A is mounted.

The drive system 1A includes, as hydraulic actuators, a bucket cylinder 15, an arm cylinder 14, and a boom cylinder 13, which are shown in FIG. 2, and also a turning motor and a pair of right and left running motors, which are not shown. The drive system 1A further includes a first hydraulic pump 11 and a second hydraulic pump 12, which supply hydraulic oil to the aforementioned hydraulic actuators. It should be noted that, in FIG. 1, the hydraulic actuators except the arm cylinder 14 and the boom cylinder 13 are not shown, and control valves intended for the unshown hydraulic actuators are also not shown.

The supply of the hydraulic oil to the arm cylinder 14 is controlled by an arm main control valve 51 and an arm auxiliary control valve 52. The supply of the hydraulic oil to the boom cylinder 13 is controlled by a boom main control valve 41 and a boom auxiliary control valve 42. A first bleed line 21 extends from the first hydraulic pump 11 to a tank, and a second bleed line 31 extends from the second hydraulic pump 12 to the tank. On the first bleed line 21, the boom auxiliary control valve 42 and the arm main control valve 51 are disposed in series. On the second bleed line 31, the boom main control valve 41 and the arm auxiliary control valve 52 are disposed in series.

Although not illustrated, a turning control valve that controls the supply of the hydraulic oil to the turning motor is disposed on the first bleed line 21, and a bucket control valve that controls the supply of the hydraulic oil to the bucket cylinder 15 is disposed on the second bleed line 31. In addition, a pair of running control valves controlling the supply of the hydraulic oil to the pair of right and left running motors is disposed on the first and second bleed lines 21 and 31.

Among the above control valves, only the boom auxiliary control valve 42 is a two-position valve, and the other control valves are three-position valves.

A parallel line 24 branches off from the first bleed line 21. Through the parallel line 24, the hydraulic oil discharged from the first hydraulic pump 11 is led to all the control valves on the first bleed line 21. Similarly, a parallel line 34 branches off from the second bleed line 31. Through the parallel line 34, the hydraulic oil discharged from the second hydraulic pump 12 is led to all the control valves on the second bleed line 31. The control valves on the first bleed line 21 except the boom auxiliary control valve 42 are connected to the tank by a tank line 25, whereas all the control valves on the second bleed line 31 are connected to the tank by a tank line 35.

All the control valves disposed on the first bleed line 21 and the second bleed line 31 are open center valves. That is, when all the control valves on the bleed line (21 or 31) are at their neutral positions, the flow of the hydraulic oil in the bleed line is not restricted by the control valves, and if any of the control valves moves and shifts from its neutral position, the flow of the hydraulic oil in the bleed line is restricted by the control valve.

In the present embodiment, the discharge flow rate of the first hydraulic pump 11 and the discharge flow rate of the second hydraulic pump 12 are controlled by a negative control method. Specifically, the first bleed line 21 is provided with a throttle 22, which is positioned downstream of all the control valves on the first bleed line 21. A relief valve 23 is disposed on a line that bypasses the throttle 22. Similarly, the second bleed line 31 is provided with a throttle 32, which is positioned downstream of all the control valves on the second bleed line 31. A relief valve 33 is disposed on a line that bypasses the throttle 32.

Each of the first hydraulic pump 11 and the second hydraulic pump 12 is driven by an engine that is not shown, and discharges the hydraulic oil at a flow rate corresponding to the tilting angle of the pump and the engine speed. In the present embodiment, swash plate pumps each defining its tilting angle by the angle of a swash plate 11*a* (see FIG. 3) are adopted as the first hydraulic pump 11 and the second hydraulic pump 12. However, as an alternative, bent axis pumps each defining the tilting angle by the angle of its axis may be adopted as the first hydraulic pump 11 and the second hydraulic pump 12.

The tilting angle of the first hydraulic pump 11 is controlled by a first regulator 16, and the tilting angle of the second hydraulic pump 12 is controlled by a second regulator 17. The discharge pressure of the first hydraulic pump 11 is led to the first regulator 16, and the discharge pressure of the second hydraulic pump 12 is led to the second regulator 17. A solenoid proportional valve 91 outputs a power shift pressure to the first regulator 16 and the second regulator 17.

The solenoid proportional valve 91 is connected to an auxiliary pump 18 by a primary pressure line 92, and the auxiliary pump 18 is driven by the aforementioned engine, which is not shown. A controller 8 controls the solenoid proportional valve 91 based on, for example, the speed of the unshown engine. For example, the speed of the engine is divided into a plurality of engine operation regions. The power shift pressure outputted from the solenoid proportional valve 91 is set for each of the engine operation regions.

Figure 3:
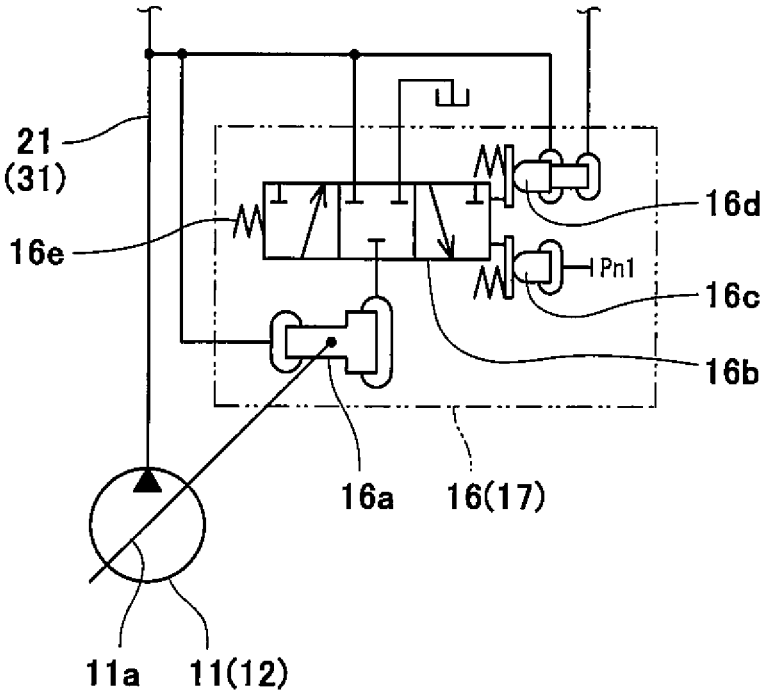
FIG. 3 is a hydraulic circuit diagram showing the configuration of a regulator.

As shown in FIG. 3, the first regulator 16 includes: a servo cylinder 16*a* coupled to the swash plate 11*a* of the first hydraulic pump 11; a spool 16*b* for controlling the servo cylinder 16*a*; a spring 16*e* urging the spool 16*b*; and a negative control piston 16*c* and a horsepower control piston 16*d*, each of which pushes the spool 16*b* against the urging force of the spring 16*e*.

The servo cylinder 16*a* decreases the tilting angle of the first hydraulic pump 11 when the spool 16*b* is pushed by the negative control piston 16*c* or the horsepower control piston 16*d*, and increases the tilting angle of the first hydraulic pump 11 when the spool 16*b* is moved by the urging force of the spring 16*e*. The discharge flow rate of the first hydraulic pump 11 decreases in accordance with a decrease in the tilting angle of the first hydraulic pump 11, and the discharge flow rate of the first hydraulic pump 11 increases in accordance with an increase in the tilting angle of the first hydraulic pump 11.

A pressure receiving chamber for causing the negative control piston 16*c* to push the spool 16*b* is formed in the first regulator 16. A first negative control pressure Pn1, which is the pressure at the upstream side of the throttle 22 on the first bleed line 21, is led to the pressure receiving chamber of the negative control piston 16*c*. The first negative control pressure Pn1 is determined by the degree of restriction of the flow of the hydraulic oil by the control valves (42, 51) on the first bleed line 21. When the first negative control pressure Pn1 increases, the negative control piston 16*c* advances (i.e., moves to the left in the diagram) and thereby the tilting angle of the first hydraulic pump 11 decreases. When the first negative control pressure Pn1 decreases, the negative control piston 16*c* retreats (i.e., moves to the right in the diagram) and thereby the tilting angle of the first hydraulic pump 11 increases.

The horsepower control piston 16*d* is a piston for controlling the tilting angle of the first hydraulic pump 11 based on the discharge pressure of the first hydraulic pump 11 and the power shift pressure. To be specific, two pressure receiving chambers for causing the horsepower control piston 16*d* to push the spool 16*b* are formed in the first regulator 16. The discharge pressure of the first hydraulic pump 11 and the power shift pressure from the solenoid proportional valve 91 are led to the two pressure receiving chambers of the horsepower control piston 16*d*, respectively.

It should be noted that the negative control piston 16*c* and the horsepower control piston 16*d* are configured such that pushing of the spool 16*b* by one of these pistons is prioritized over pushing of the spool 16*b* by the other piston, the one piston restricting (decreasing) the discharge flow rate of the first hydraulic pump 11 to a greater degree than the other piston.

The second regulator 17 is configured in the same manner as the first regulator 16. Specifically, the second regulator 17 controls the tilting angle of the second hydraulic pump 12 by the negative control piston 16*c* based on a second negative control pressure Pn2. The second regulator 17 also controls the tilting angle of the second hydraulic pump 12 by the horsepower control piston 16*d* based on the discharge pressure of the second hydraulic pump 12 and the power shift pressure from the solenoid proportional valve 91.

As described above, the first regulator 16 controls the tilting angle of the first hydraulic pump 11 not based on the discharge pressure of the second hydraulic pump 12, and the second regulator 17 controls the tilting angle of the second hydraulic pump 12 not based on the discharge pressure of the first hydraulic pump 11. Thus, the tilting angle of the first hydraulic pump 11 and the tilting angle of the second hydraulic pump 12 are controllable independently of each other.

Returning to FIG. 1, the boom main control valve 41 is connected to the boom cylinder 13 by a boom raising supply line 13*a* and a boom lowering supply line 13*b*. The boom auxiliary control valve 42 is connected to the boom raising supply line 13*a* by an auxiliary supply line 13*c*.

Pilot ports of the boom main control valve 41 are connected to a boom operation valve 61 by a boom raising pilot line 43 and a boom lowering pilot line 44. The boom operation valve 61 includes an operating lever, and outputs a pilot pressure whose magnitude corresponds to an operating amount of the operating lever to the boom main control valve 41. The boom raising pilot line 43 is provided with a first pressure sensor 81 for detecting the pilot pressure at the time of a boom raising operation.

A pilot port of the boom auxiliary control valve 42 is connected to a boom-side regulating valve 71 by a boom raising pilot line 45. In the present embodiment, the boom-side regulating valve 71 is a solenoid proportional valve. The boom-side regulating valve 71 is connected to the auxiliary pump 18 by a primary pressure line 74.

The arm main control valve 51 is connected to the arm cylinder 14 by an arm crowding supply line 14*a* and an arm pushing supply line 14*b*. The arm auxiliary control valve 52 is connected to the arm crowding supply line 14*a* by an auxiliary supply line 14*c*, and is connected to the arm pushing supply line 14*b* by an auxiliary supply line 14*d*.

Pilot ports of the arm main control valve 51 are connected to an arm operation valve 62 by an arm crowding pilot line 53 and an arm pushing pilot line 54. The arm operation valve 62 includes an operating lever, and outputs a pilot pressure whose magnitude corresponds to an operating amount of the operating lever to the arm main control valve 51. The arm crowding pilot line 53 is provided with a second pressure sensor 82 for detecting a pilot pressure when an arm crowding operation is performed. The arm pushing pilot line 54 is provided with a third pressure sensor 83 for detecting a pilot pressure when an arm pushing operation is performed.

Pilot ports of the arm auxiliary control valve 52 are connected to a pair of arm-side regulating valves 72 and 73 by an arm pushing pilot line 56 and an arm crowding pilot line 55. In the present embodiment, each of the arm-side regulating valves 72 and 73 is a solenoid proportional valve. The arm-side regulating valves 72 and 73 are connected to the auxiliary pump 18 by a primary pressure line 75.

The boom-side regulating valve 71 and the arm-side regulating valves 72 and 73 are controlled by the controller 8. Specifically, the controller 8 controls the arm-side regulating valves 72 and 73 such that the arm-side regulating valves 72 and 73 output pilot pressures to the arm auxiliary control valve 52 in accordance with an arm crowding operation and an arm pushing operation, respectively, when no boom raising operation is performed, and such that the arm-side regulating valves 72 and 73 output no pilot pressure to the arm auxiliary control valve 52 when an arm crowding operation and a boom raising operation are performed concurrently. The controller 8 also controls the boom-side regulating valve 71 such that the boom-side regulating valve 71 outputs a pilot pressure to the boom auxiliary control valve 42 in accordance with a boom raising operation when no arm crowding operation is performed, and such that the boom-side regulating valve 71 outputs no pilot pressure to the boom auxiliary control valve 42 when an arm crowding operation and a boom raising operation are performed concurrently.

Fist, control of the boom-side regulating valve 71 is described below in detail.

Figure 4:
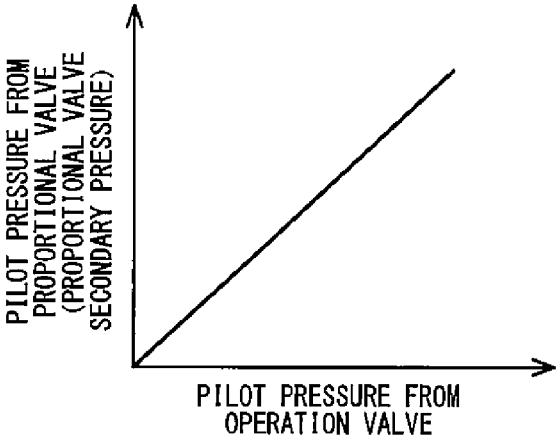
FIG. 4 is a graph showing a relationship between a pilot pressure from an operation valve and pilot pressures from solenoid proportional valves serving as an arm-side regulating valve and a boom-side regulating valve when an arm crowding operation and a boom raising operation are not performed concurrently.

The boom-side regulating valve 71, which is a solenoid proportional valve, allows the boom raising pilot line 45 to be in communication with the tank when no electric current is fed from the controller 8 to the boom-side regulating valve 71. At the time, the boom auxiliary control valve 42 is kept at its neutral position. The controller 8 feeds the boom-side regulating valve 71 with an electric current whose magnitude corresponds to the pilot pressure of the boom raising pilot line 43, the pilot pressure being detected by the first pressure sensor 81, when no arm crowding operation is performed, i.e., when the pilot pressure of the arm crowding pilot line 53, the pilot pressure being detected by the second pressure sensor 82, is less than a threshold. Accordingly, as shown in FIG. 4, the boom-side regulating valve 71 outputs, to the boom auxiliary control valve 42, a pilot pressure proportional to a pilot pressure outputted from the boom operation valve 61.

On the other hand, when an arm crowding operation and a boom raising operation are performed concurrently, i.e., when the pilot pressure of the boom raising pilot line 43 detected by the first pressure sensor 81 has become higher than or equal to a threshold and the pilot pressure of the arm crowding pilot line 53 detected by the second pressure sensor 82 has become higher than or equal to a threshold, the controller 8 feeds no electric current to the boom-side regulating valve 71. Consequently, the boom auxiliary control valve 42 does not move.

Next, control of the arm-side regulating valves 72 and 73 is described below in detail.

The arm-side regulating valves 72 and 73, which are solenoid proportional valves, allow the pilot lines 55 and 56 to be in communication with the tank when no electric current is fed from the controller 8 to the arm-side regulating valves 72 and 73. At the time, the arm auxiliary control valve 52 is kept at its neutral position. The controller 8 either feeds the arm-side regulating valve 72 with an electric current whose magnitude corresponds to the pilot pressure of the arm crowding pilot line 53, the pilot pressure being detected by the second pressure sensor 82, or feeds the arm-side regulating valve 73 with an electric current whose magnitude corresponds to the pilot pressure of the arm pushing pilot line 54, the pilot pressure being detected by the third pressure sensor 83, when no boom raising operation is performed, i.e., when the pilot pressure of the boom raising pilot line 43 detected by the first pressure sensor 81 is less than a threshold. Accordingly, as shown in FIG. 4, one of the arm-side regulating valves 72 and 73 outputs, to the arm auxiliary control valve 52, a pilot pressure proportional to a pilot pressure outputted from the arm operation valve 62.

On the other hand, when an arm crowding operation and a boom raising operation are performed concurrently, the controller 8 feeds no electric current to the arm-side regulating valves 72 and 73. Consequently, the arm auxiliary control valve 52 does not move.

As described above, in the drive system 1A of the present embodiment, the arm auxiliary control valve 52 and the boom auxiliary control valve 42 do not move when an arm crowding operation and a boom raising operation are performed concurrently. This makes it possible to use the first hydraulic pump 11 as a pump dedicated for the arm cylinder 14 and use the second hydraulic pump 12 as a pump dedicated for the boom cylinder 13. This consequently makes it possible to prevent a large amount of hydraulic oil from flowing into one of the arm cylinder 14 and the boom cylinder 13 whose load pressure is lower. It should be noted that the term "dedicated" herein is intended to exclude only one of the arm cylinder 14 and the boom cylinder 13, and is not necessarily intended to exclude the other hydraulic actuators (e.g., the bucket cylinder 15).

In addition, the tilting angle of the first hydraulic pump 11 and the tilting angle of the second hydraulic pump 12 are controllable independently of each other. In other words, independent horsepower control is performed on both the hydraulic pumps 11 and 12. Therefore, the amount of hydraulic oil supplied to the arm cylinder 14 and the amount of hydraulic oil supplied to the boom cylinder 13 can be set based on horsepower control characteristics of the first hydraulic pump 11 and horsepower control characteristics of the second hydraulic pump 12, respectively, in accordance with the load pressure of the arm cylinder 14 and the load pressure of the boom cylinder 13.

Figure 5A:
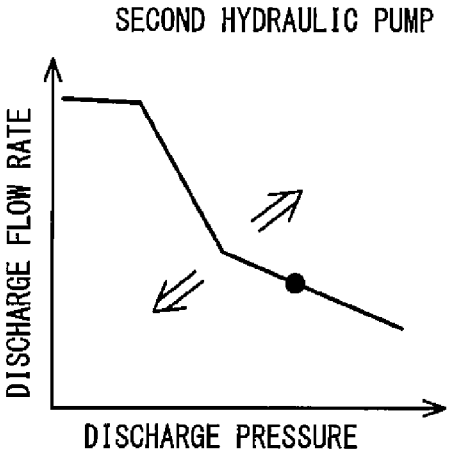
FIG. 5A is a graph showing horsepower control characteristics of a second hydraulic pump of Embodiment 1.
Figure 5B:
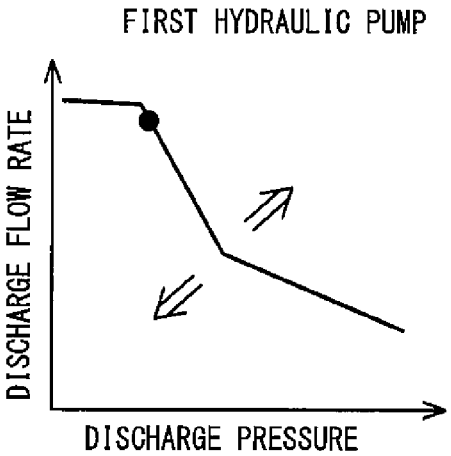
FIG. 5B is a graph showing horsepower control characteristics of a first hydraulic pump of Embodiment 1.

For example, FIG. 5A shows horsepower control characteristics of the second hydraulic pump 12, which are defined by the second regulator 17. FIG. 5B shows horsepower control characteristics of the first hydraulic pump 11, which are defined by the first regulator 16. When an arm crowding operation and a boom raising operation are performed concurrently, i.e., when the bucket is moved horizontally and brought closer to the body of the excavator, generally speaking, the discharge pressure of the first hydraulic pump 11, which is the load pressure of the arm cylinder 14, is relatively low, and the discharge pressure of the second hydraulic pump 12, which is the load pressure of the boom cylinder 13, is relatively high. The discharge flow rate of the first hydraulic pump 11 transitions in line with the horsepower control characteristics shown in FIG. 5B in accordance with the discharge pressure of the first hydraulic pump 11, and the discharge flow rate of the second hydraulic pump 12 transitions in line with the horsepower control characteristics shown in FIG. 5A in accordance with the discharge pressure of the second hydraulic pump 12. It should be noted that the first and second regulators 16 and 17 may be configured such that the horsepower control characteristics shown in FIG. 5B and the horsepower control characteristics shown in FIG. 5A both correspond to ½ of the engine output. In the hydraulic excavator drive system 1A according to the present embodiment, unnecessary pressure loss does not occur in a path from the first hydraulic pump 11 to the arm cylinder 14 and in a path from the second hydraulic pump 12 to the boom cylinder 13. This makes it possible to suppress wasteful energy consumption.

Further, in the present embodiment, since a power shift pressure is outputted from the solenoid proportional valve 91 to the first regulator 16 and the second regulator 17, power shift control can be performed on both the first hydraulic pump 11 and the second hydraulic pump 12 by the single solenoid proportional valve. That is, by changing the power shift pressure, the horsepower control characteristics shown in FIG. 5A and the horsepower control characteristics shown in FIG. 5B can be shifted concurrently as indicated by arrows shown in FIG. 5A and FIG. 5B.

Still further, in the present embodiment, all the boom-side regulating valve 71 and the arm-side regulating valves 72 and 73 are solenoid proportional valves that output, to the auxiliary control valves 42 and 52, pilot pressures proportional to pilot pressures outputted from the operation valves 61 and 62. For this reason, when no boom raising operation is performed, the arm auxiliary control valve 52 can be moved in the same manner as the arm main control valve 51. Also, when no arm crowding operation is performed, the boom auxiliary control valve 42 can be moved in the same manner as the boom main control valve 41.

Still further, in the present embodiment, even if an electric current stops flowing to the boom-side regulating valve 71 and the arm-side regulating valves 72 and 73, which are solenoid proportional valves, due to a fault in an electrical system, the boom cylinder 13 and the arm cylinder 14 can be moved at a certain speed since the boom main control valve 41 and the arm main control valve 51 remain movable.

Embodiment 2

Figure 6:
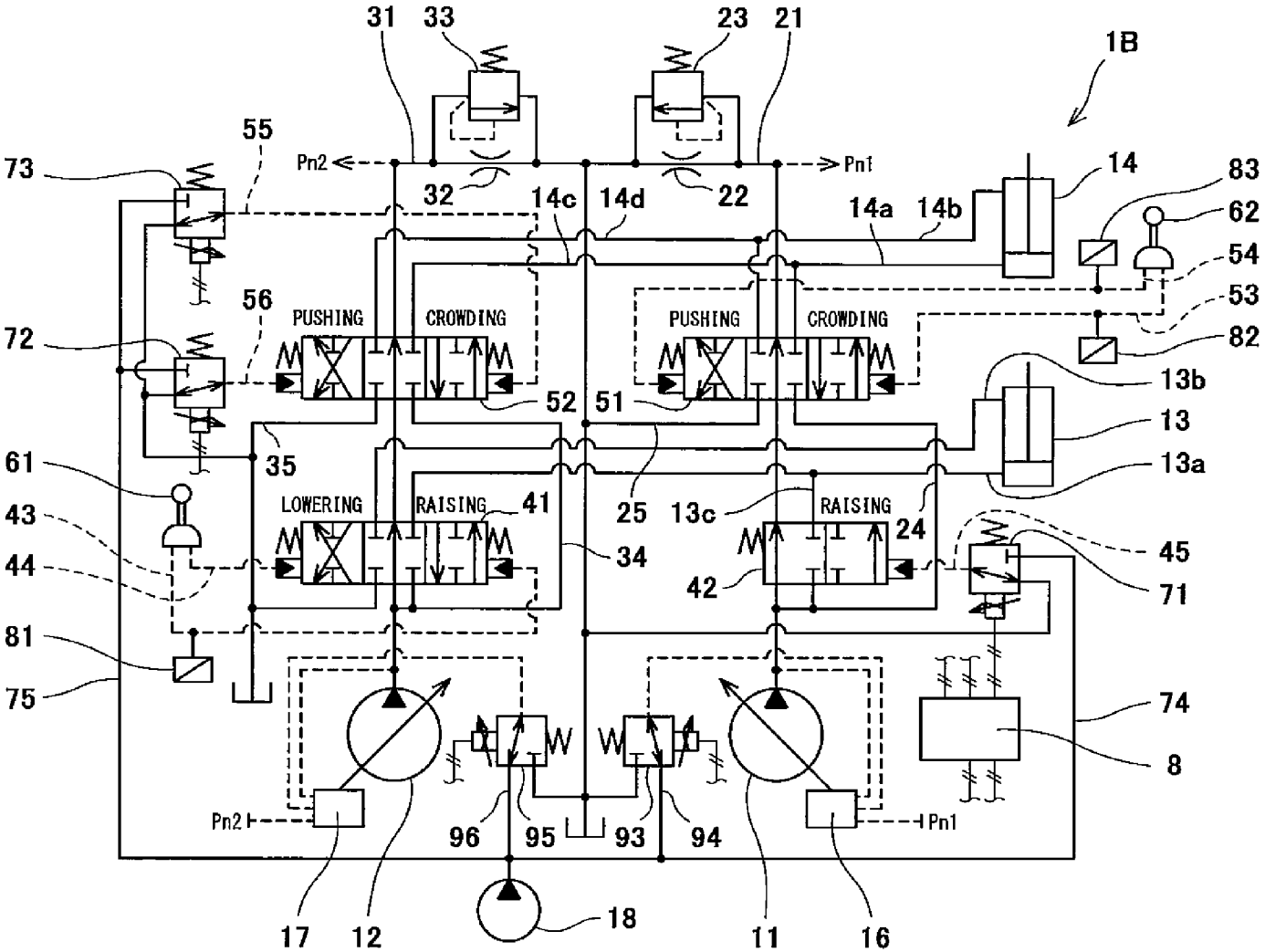
FIG. 6 is a hydraulic circuit diagram of a hydraulic excavator drive system according to Embodiment 2 of the present invention.

Next, with reference to FIG. 6, a hydraulic excavator drive system 1B according to Embodiment 2 of the present invention is described. It should be noted that, in the present embodiment and Embodiment 3 described below, the same components as those described in Embodiment 1 are denoted by the same reference signs as those used in Embodiment 1, and repeating the same descriptions is avoided below.

In the present embodiment, a first solenoid proportional valve 93 and a second solenoid proportional valve 95 are adopted as solenoid proportional valves for power shift control. The first solenoid proportional valve 93 is connected to the auxiliary pump 18 by a primary pressure line 94, and the second solenoid proportional valve 95 is connected to the auxiliary pump 18 by a primary pressure line 96. The first solenoid proportional valve 93 outputs a first power shift pressure to the first regulator 16, and the second solenoid proportional valve 95 outputs a second power shift pressure to the second regulator 17. Then, the first regulator 16 controls the tilting angle of the first hydraulic pump 11 based on the discharge pressure of the first hydraulic pump 11 and the first power shift pressure, and the second regulator 17 controls the tilting angle of the second hydraulic pump 12 based on the discharge pressure of the second hydraulic pump 12 and the second power shift pressure.

The present embodiment produces the same advantageous effects as those produced by Embodiment 1. In addition, in the present embodiment, power shift control of the first hydraulic pump 11 and power shift control of the second hydraulic pump 12 can be performed independently of each other. Accordingly, the amount of hydraulic oil supplied to the arm cylinder 14 and the amount of hydraulic oil supplied to the boom cylinder 13 can be controlled by utilizing the power shift control of the first hydraulic pump 11 and the power shift control of the second hydraulic pump 12, respectively.

Figure 7A:
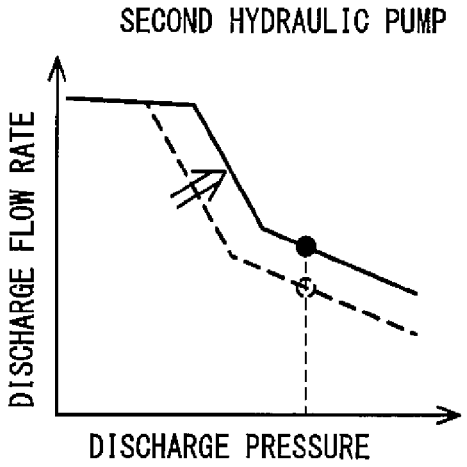
FIG. 7A is a graph showing horsepower control characteristics of a second hydraulic pump of Embodiment 2.
Figure 7B:
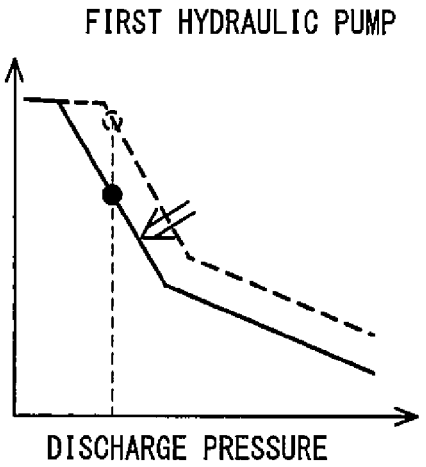
FIG. 7B is a graph showing horsepower control characteristics of a first hydraulic pump of Embodiment 2.

For example, as shown in FIG. 7A and FIG. 7B, when an arm crowding operation and a boom raising operation are performed concurrently, the controller 8 may control the first solenoid proportional valve 93 in a manner to increase the first power shift pressure such that the discharge flow rate of the first hydraulic pump 11 decreases, and control the second solenoid proportional valve 95 in a manner to decrease the second power shift pressure such that the discharge flow rate of the second hydraulic pump 12 increases.

Embodiment 3

Figure 8:
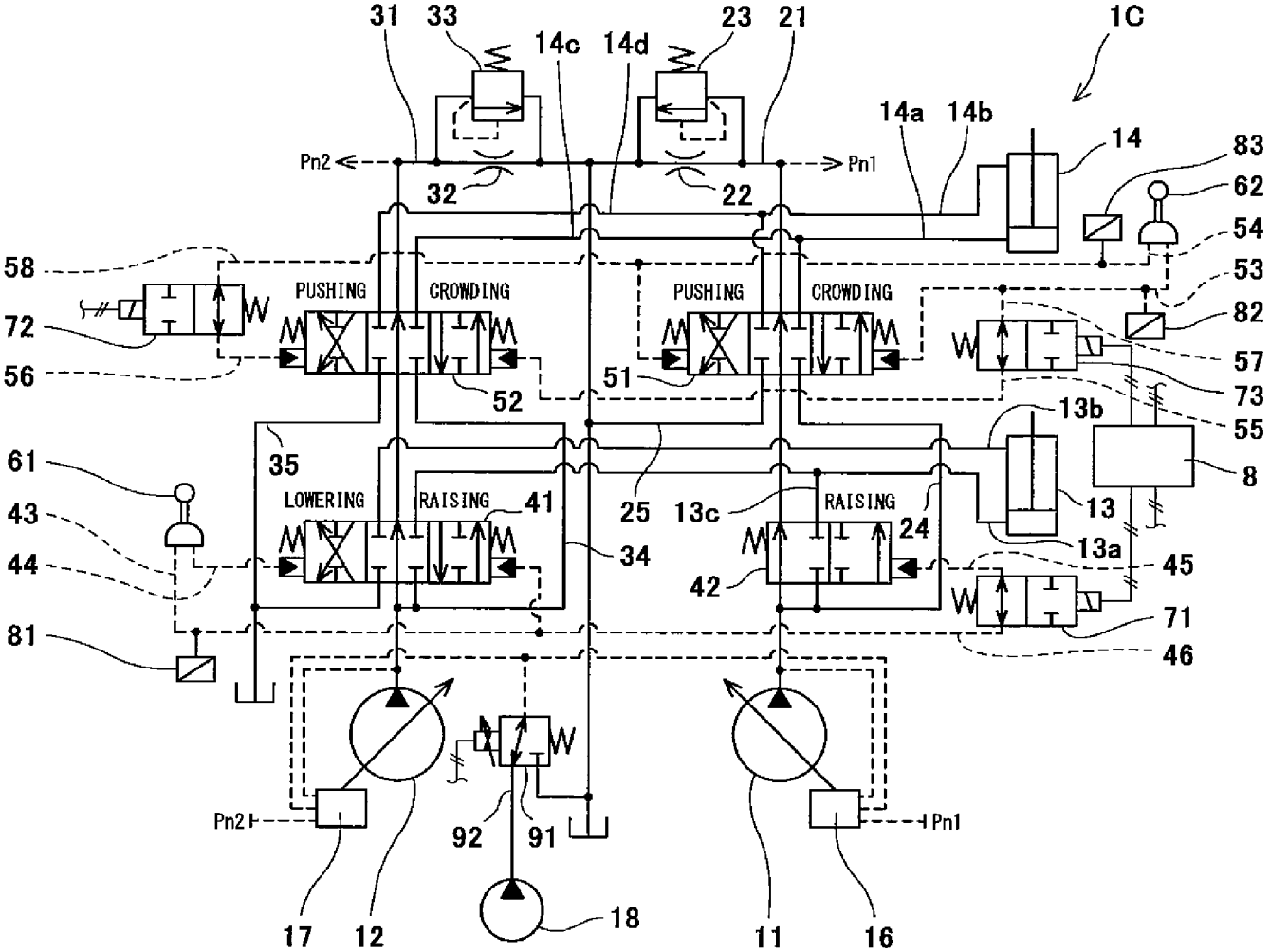
FIG. 8 is a hydraulic circuit diagram of a hydraulic excavator drive system according to Embodiment 3 of the present invention.
Figure 9:
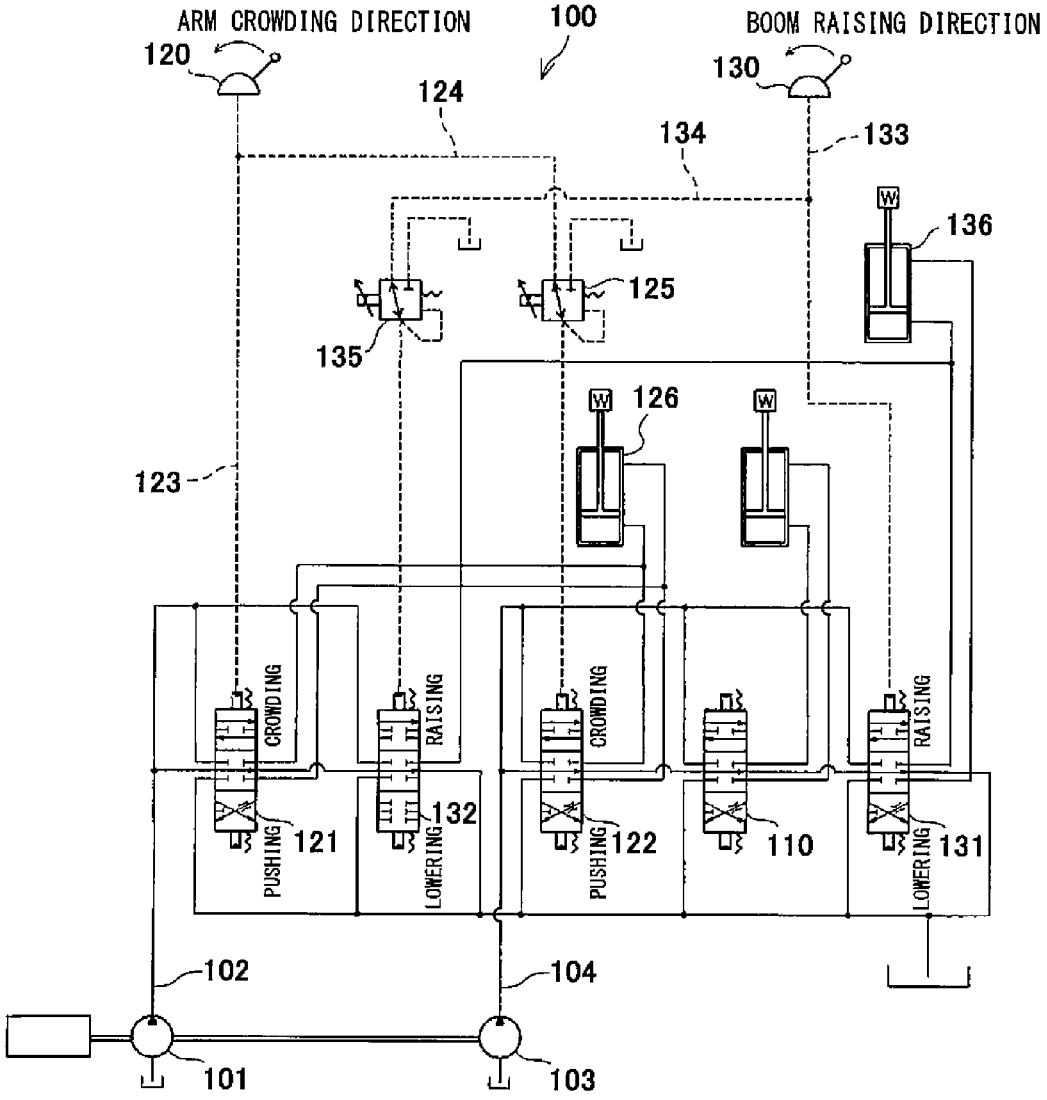
FIG. 9 is a hydraulic circuit diagram of a conventional hydraulic excavator drive system.

Next, with reference to FIG. 8, a hydraulic excavator drive system 1C according to Embodiment 3 of the present invention is described. In the present embodiment, solenoid on-off valves are adopted as the boom-side regulating valve 71 and the arm-side regulating valves 72 and 73.

The boom-side regulating valve 71 is connected by a relay line 46 to the boom raising pilot line 43, which extends from the boom operation valve 61 to the pilot port of the boom main control valve 41. Meanwhile, the arm-side regulating valve 72 is connected by a first relay line 58 to the arm pushing pilot line 54, which extends from the arm operation valve 62 to the pilot port of the arm main control valve 51, and the arm-side regulating valve 73 is connected by a second relay line 57 to the arm crowding pilot line 53, which extends from the arm operation valve 62 to the pilot port of the arm main control valve 51.

The controller 8 feeds no electric current to the boom-side regulating valve 71 and the arm-side regulating valves 72 and 73, which are solenoid on-off valves, unless an arm crowding operation and a boom raising operation are performed concurrently. Accordingly, the boom-side regulating valve 71 allows the boom raising pilot line 45 intended for the boom auxiliary control valve 42 to be in communication with the boom raising pilot line 43 intended for the boom main control valve 41 via the relay line 46, and the arm-side regulating valves 72 and 73 allow the arm pushing pilot line 56 and the arm crowding pilot line 55 intended for the arm auxiliary control valve 52 to be in communication with the arm pushing pilot line 54 and the arm crowding pilot line 53 intended for the arm main control valve 51 via the first relay line 58 and the second relay line 57, respectively. That is, the boom-side regulating valve 71 outputs a pilot pressure to the boom auxiliary control valve 42 in accordance with a boom raising operation, and the arm-side regulating valves 72 and 73 output pilot pressures to the arm auxiliary control valve 52 in accordance with an arm crowding operation and an arm pushing operation.

On the other hand, when an arm crowding operation and a boom raising operation are performed concurrently, the controller 8 feeds an electric current to each of the boom-side regulating valve 71 and the arm-side regulating valves 72 and 73. Accordingly, the boom-side regulating valve 71 blocks the boom raising pilot line 45, and the arm-side regulating valve 72 and the arm-side regulating valve 73 block the arm pushing pilot line 56 and the arm crowding pilot line 55, respectively. That is, the boom-side regulating valve 71 outputs no pilot pressure to the boom auxiliary control valve 42, and the arm-side regulating valves 72 and 73 output no pilot pressure to the arm auxiliary control valve 52.

The configuration according to the present embodiment makes it possible to realize a simpler configuration and simpler control logic than in a case where solenoid proportional valves are adopted as the boom-side regulating valve 71 and the arm-side regulating valves 72 and 73.

Further, in the present embodiment, no pilot pressure is outputted to the boom auxiliary control valve 42 and the arm auxiliary control valve 52 when the boom operation valve 61 and the arm operation valve 62 are not operated. This makes it possible to prevent erroneous movement of the boom cylinder 13 and the arm cylinder 14.

It should be noted that, in the hydraulic circuit shown in FIG. 8, solenoid proportional valves such as those described in Embodiment 1 can be adopted as the boom-side regulating valve 71 and the arm-side regulating valves 72 and 73. Alternatively, among the boom-side regulating valve 71 and the arm-side regulating valves 72 and 73, either the boom-side regulating valve 71 or the arm-side regulating valves 72 and 73 may be (a) solenoid on-off valve(s), and the other regulating valve(s) may be (a) solenoid proportional valve(s).

Also, similar to Embodiment 2, the first solenoid proportional valve 93, which outputs the first power shift pressure to the first regulator 16, and the second solenoid proportional valve 95, which outputs the second power shift pressure to the second regulator 17, may be adopted in place of the solenoid proportional valve 91, which outputs a power shift pressure to the first regulator 16 and the second regulator 17.

Other Embodiments

In the above-described Embodiments 1 to 3, the method of controlling the discharge flow rate of each of the first and second hydraulic pumps 11 and 12 need not be a negative control method, but may be a positive control method. That is, each of the first and second regulators 16 and 17 may include a structure that replaces the negative control piston 16*c*. Moreover, the method of controlling the discharge flow rate of each of the first and second hydraulic pumps 11 and 12 may be a load-sensing method.

INDUSTRIAL APPLICABILITY

The present invention is useful not only for self-propelled hydraulic excavators but also for various types of hydraulic excavators.

REFERENCE SIGNS LIST

1A to 1C hydraulic excavator drive system
11 first hydraulic pump
12 second hydraulic pump
13 boom cylinder
14 arm cylinder
16 first regulator
17 second regulator
21 first bleed line
31 second bleed line
41 boom main control valve
42 boom auxiliary control valve
51 arm main control valve
52 arm auxiliary control valve
61 boom operation valve
62 arm operation valve
71 boom-side regulating valve
72, 73 arm-side regulating valve
8 controller
91 solenoid proportional valve
93 first solenoid proportional valve
95 second solenoid proportional valve

The invention claimed is:

1. A hydraulic excavator drive system comprising:

a first hydraulic pump and a second hydraulic pump, whose respective tilting angles are controllable independently of each other, each pump discharging hydraulic oil at a flow rate corresponding to the tilting angle of the pump;

an arm main control valve and an arm auxiliary control valve each for controlling supply of the hydraulic oil to an arm cylinder, the arm main control valve being disposed on a first bleed line extending from the first hydraulic pump, the arm auxiliary control valve being disposed on a second bleed line extending from the second hydraulic pump;

a boom main control valve and a boom auxiliary control valve each for controlling supply of the hydraulic oil to a boom cylinder, the boom main control valve being disposed on the second bleed line, the boom auxiliary control valve being disposed on the first bleed line;

an arm operation valve that outputs a pilot pressure to the arm main control valve;

a boom operation valve that outputs a pilot pressure to the boom main control valve;

a pair of arm-side regulating valves that output pilot pressures to the arm auxiliary control valve in accordance with an arm crowding operation and an arm pushing operation, respectively, when no boom raising operation is performed, and output no pilot pressure to the arm auxiliary control valve when an arm crowding operation and a boom raising operation are performed concurrently; and a boom-side regulating valve that outputs a pilot pressure to the boom auxiliary control valve in accordance with a boom raising operation when no arm crowding operation is performed, and outputs no pilot pressure to the boom auxiliary control valve when an arm crowding operation and a boom raising operation are performed concurrently.

2. The hydraulic excavator drive system according to claim 1, wherein each of the pair of arm-side regulating valves is a solenoid proportional valve that outputs, to the arm auxiliary control valve, a pilot pressure proportional to the pilot pressure outputted from the arm operation valve when no boom raising operation is performed, and the boom-side regulating valve is a solenoid proportional valve that outputs, to the boom auxiliary control valve, a pilot pressure proportional to the pilot pressure outputted from the boom operation valve when no arm crowding operation is performed.

3. The hydraulic excavator drive system according to claim 1, wherein each of the pair of arm-side regulating valves is a solenoid on-off valve that blocks a pilot line intended for the arm auxiliary control valve when an arm crowding operation and a boom raising operation are performed concurrently, and the boom-side regulating valve is a solenoid on-off valve that blocks a pilot line intended for the boom auxiliary control valve when an arm crowding operation and a boom raising operation are performed concurrently.

4. The hydraulic excavator drive system according to claim 1, further comprising:

a first regulator that controls the tilting angle of the first hydraulic pump based on a discharge pressure of the first hydraulic pump and a power shift pressure;

a second regulator that controls the tilting angle of the second hydraulic pump based on a discharge pressure of the second hydraulic pump and the power shift pressure; and a solenoid proportional valve that outputs the power shift pressure to the first regulator and the second regulator.

5. The hydraulic excavator drive system according to claim 1, further comprising:

a first regulator that controls the tilting angle of the first hydraulic pump based on a discharge pressure of the first hydraulic pump and a first power shift pressure;

a first solenoid proportional valve that outputs the first power shift pressure to the first regulator;

a second regulator that controls the tilting angle of the second hydraulic pump based on a discharge pressure of the second hydraulic pump and a second power shift pressure; and a second solenoid proportional valve that outputs the second power shift pressure to the second regulator.

6. The hydraulic excavator drive system according to claim 5, further comprising a controller that, when an arm crowding operation and a boom raising operation are performed concurrently, controls the first solenoid proportional valve in a manner to increase the first power shift pressure such that a discharge flow rate of the first hydraulic pump decreases, and controls the second solenoid proportional valve in a manner to decrease the second power shift pressure such that a discharge flow rate of the second hydraulic pump increases.

7. The hydraulic excavator drive system according to claim 2, further comprising:

a first regulator that controls the tilting angle of the first hydraulic pump based on a discharge pressure of the first hydraulic pump and a power shift pressure;

a second regulator that controls the tilting angle of the second hydraulic pump based on a discharge pressure of the second hydraulic pump and the power shift pressure; and a solenoid proportional valve that outputs the power shift pressure to the first regulator and the second regulator.

8. The hydraulic excavator drive system according to claim 3, further comprising:

a first regulator that controls the tilting angle of the first hydraulic pump based on a discharge pressure of the first hydraulic pump and a power shift pressure;

a second regulator that controls the tilting angle of the second hydraulic pump based on a discharge pressure of the second hydraulic pump and the power shift pressure; and a solenoid proportional valve that outputs the power shift pressure to the first regulator and the second regulator.

9. The hydraulic excavator drive system according to claim 2, further comprising:

a first regulator that controls the tilting angle of the first hydraulic pump based on a discharge pressure of the first hydraulic pump and a first power shift pressure;

a first solenoid proportional valve that outputs the first power shift pressure to the first regulator;

a second regulator that controls the tilting angle of the second hydraulic pump based on a discharge pressure of the second hydraulic pump and a second power shift pressure; and a second solenoid proportional valve that outputs the second power shift pressure to the second regulator.

10. The hydraulic excavator drive system according to claim 3, further comprising:

a first regulator that controls the tilting angle of the first hydraulic pump based on a discharge pressure of the first hydraulic pump and a first power shift pressure;

a first solenoid proportional valve that outputs the first power shift pressure to the first regulator;

a second regulator that controls the tilting angle of the second hydraulic pump based on a discharge pressure of the second hydraulic pump and a second power shift pressure; and a second solenoid proportional valve that outputs the second power shift pressure to the second regulator.

* * * * *